US009767760B2

(12) United States Patent
Takahashi

(10) Patent No.: US 9,767,760 B2
(45) Date of Patent: Sep. 19, 2017

(54) DRIVING DEVICE FOR DISPLAY DEVICE

(71) Applicant: LAPIS Semiconductor Co., Ltd., Yokohama (JP)

(72) Inventor: Yuuichi Takahashi, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 247 days.

(21) Appl. No.: 14/639,073

(22) Filed: Mar. 4, 2015

(65) Prior Publication Data

US 2015/0255035 A1 Sep. 10, 2015

(30) Foreign Application Priority Data

Mar. 5, 2014 (JP) ..... 2014-042363

(51) Int. Cl.
*G09G 3/36* (2006.01)

(52) U.S. Cl.
CPC ..... *G09G 3/3696* (2013.01); *G09G 3/3688* (2013.01); *G09G 2300/0426* (2013.01); *G09G 2310/0218* (2013.01); *G09G 2310/0289* (2013.01); *G09G 2310/0291* (2013.01); *G09G 2320/0223* (2013.01); *G09G 2320/0233* (2013.01); *G09G 2320/0271* (2013.01)

(58) Field of Classification Search
CPC ..... G09G 3/3696; G09G 3/3688; G09G 2310/0291; G09G 2320/0223; G09G 2300/0426; G09G 2310/0218; G09G 2320/0233; G09G 2320/0271; G09G 2310/0289
See application file for complete search history.

(56) References Cited

U.S. PATENT DOCUMENTS

2008/0266276 A1* 10/2008 Choi ..... G09G 3/3685 345/204
2011/0057922 A1* 3/2011 Yasuda ..... H03F 3/45183 345/212
2014/0300649 A1* 10/2014 Park ..... G09G 3/006 345/690
2015/0035813 A1* 2/2015 Lei ..... G09G 3/3208 345/205

FOREIGN PATENT DOCUMENTS

JP 2004-301946 A 10/2004

* cited by examiner

*Primary Examiner* — Patrick Edouard
*Assistant Examiner* — Maheen Javed
(74) *Attorney, Agent, or Firm* — Rabin & Berdo, P.C.

(57) ABSTRACT

A driving device for a display device wherein the display device and a source driver are connected by a plurality of external lines. A bias voltage generating part generates a bias voltage for controlling internal operating current of the plurality of amplifiers in the source driver to supply to each amplifier via a bias voltage supply line. The bias voltage supply line is laid out such that for the amplifier connected to the external line of a longer length, the length of the bias voltage supply line from the bias voltage generating part to the amplifier is shorter so as to raise a bias voltage supplied to the amplifier.

6 Claims, 8 Drawing Sheets

DRIVING DEVICE FOR DISPLAY DEVICE

BACKGROUND OF THE INVENTION

1. Field of the Invention

The present invention relates to a display-device driving device that drives a display device according to a video signal.

2. Description of the Related Art

In, for example, a liquid crystal display panel as a display device, a plurality of gate lines extending in a horizontal direction of the two-dimensional screen and a plurality of source lines extending in a vertical direction of the two-dimensional screen are arranged to intersect. Further, in the liquid crystal display panel, a source driver that applies gradation display voltages corresponding to the luminance levels of pixels denoted by an input video signal to the source lines respectively and a gate driver that applies scan signals to the gate lines respectively are incorporated (refer to, e.g., Japanese Patent Application Laid-Open No. 2004-301946). In this source driver, by making timings when the latches take in display data differ from one another by means of delay circuits using the element delays of inverter elements, the state where steep changes in the amounts of current of the source lines occur simultaneously is avoided so as to prevent noise that would occur if in this state.

SUMMARY OF THE INVENTION

Where a liquid crystal display panel having a size greater than the chip size of the source driver is driven by a single source driver, the respective lengths of lines connecting the source driver and the source lines of the liquid crystal display panel are not the same. Thus, the wiring resistances of the lines are different, and hence times until gradation display voltages sent out from the driver reach the source lines are different. Therefore, gradation display voltages are supplied to pixels connected to source lines placed farther from the driver with greater delays, which causes the problem that display unevenness occurs.

An object of the present invention is to provide a display-device driving device that can perform image display of high quality without display unevenness even if the lengths of a plurality of lines connecting between a display device and the driver are different.

According to the present invention, there is provided a driving device for driving a display device which has a source driver that applies pixel drive voltages respectively denoting luminance levels of pixels to a plurality of source lines of the display device via external lines respectively. The source driver includes: a plurality of amplifiers provided correspondingly to the plurality of source lines respectively and configured to generate the pixel drive voltages so as to supply it to the external lines respectively, the respective one of the plurality of amplifiers having a control terminal and operating with a transition speed in accordance with a voltage supplied thereto via the control terminal; a bias voltage supply line having its opposed ends; and a bias voltage generating part that generates a bias voltage and supplies the bias voltage across the opposed ends. The bias voltage supply line is connected to the control terminal of the respective one of the amplifiers so that the respective length from the either one end of said bias voltage supply line to the respective control terminal of the amplifiers correspond in length to the external line connected to the respective one of the amplifier.

According to the present invention, there is provided a driving device for a display device which has a source driver that applies pixel drive voltages respectively denoting luminance levels of pixels to a plurality of source lines of the display device via external lines respectively. The source driver includes a first group of amplifiers provided corresponding to source lines in charge of the left region of a two-dimensional screen of the display device from among the plurality of source lines and that generate the pixel drive voltages to send onto the external lines respectively; a second group of amplifiers provided corresponding to source lines in charge of the right region of the two-dimensional screen of the display device from among the plurality of source lines and that generate the pixel drive voltages to send onto the external lines respectively; a bias voltage generating part that generates a bias voltage for controlling output delays of the first and second groups of amplifiers; a first bias voltage supply line via which to supply the bias voltage to the first group of amplifiers; and a second bias voltage supply line via which to supply the bias voltage to the second group of amplifiers. The bias voltage generating part has a first terminal connected to one end of the first bias voltage supply line, a second terminal connected to the other end thereof, a third terminal connected to one end of the second bias voltage supply line, and a fourth terminal connected to the other end thereof. In a first mode, the bias voltage is applied to the first terminal and the third terminal, and simultaneously a voltage lower than the bias voltage is applied to the second terminal and the fourth terminal, and in a second mode, with the second terminal and the fourth terminal being short-circuited, the bias voltage is applied to the first terminal, and simultaneously a voltage lower than the bias voltage is applied to the third terminal, and in a third mode, with the second terminal and the fourth terminal being short-circuited, the bias voltage is applied to the third terminal, and simultaneously a voltage lower than the bias voltage is applied to the first terminal. The longer the length of the external line connected to any of the amplifiers is, the shorter the length of the first and second bias voltage supply lines connecting a terminal to which the bias voltage is applied from among the first and third terminals and an input terminal of the amplifier is.

DETAILED DESCRIPTION OF THE INVENTION

An embodiment of the present invention will be described in detail below with reference to the drawings.

Figure 1:
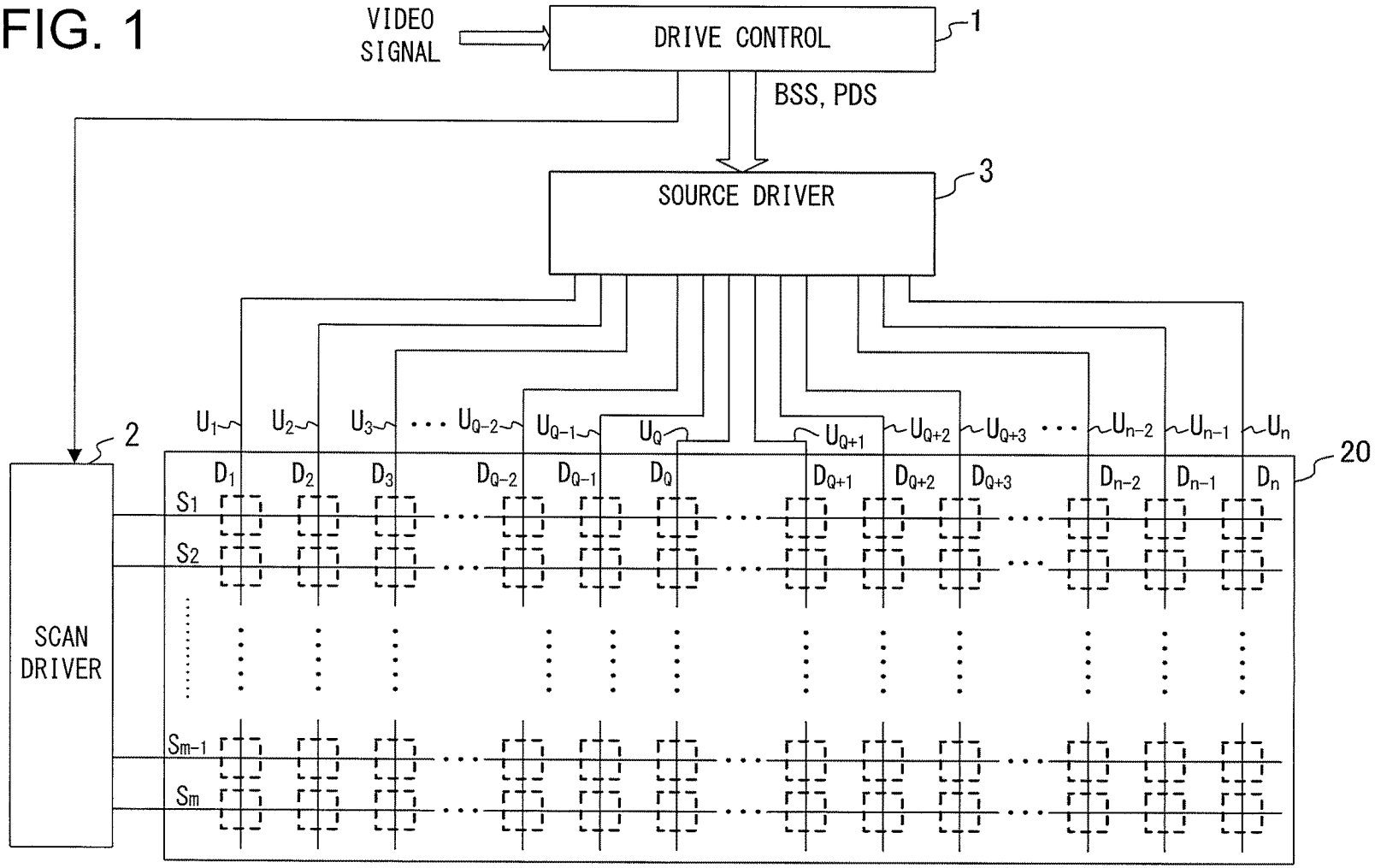
FIG. 1 is a block diagram showing a display apparatus including a driving device according to the present invention.

FIG. 1 is a diagram showing schematically the configuration of a display apparatus having incorporated therein a driving device for a display device according to the present invention. As shown in FIG. 1, this display apparatus includes a drive control part 1, a scan driver 2, a source driver 3, and a display device 20.

The display device 20 is constituted by, e.g., a liquid crystal or organic EL panel, or the like. In the display device 20, there are formed m number of horizontal scan lines $S_1$ to $S_m$ (m is a natural number of two or greater), which extend in a horizontal direction of a two-dimensional screen and n number of source lines $D_1$ to $D_n$ (n is a natural number of two or greater), which extend in a vertical direction of the two-dimensional screen. Further, in each of the intersection regions of the horizontal scan lines and the source lines, a display cell for a pixel is formed.

The drive control part 1 extracts a horizontal synchronizing signal from a video signal to supply this signal to the scan driver 2. Further, the drive control part 1 generates a sequence of pixel data PD each denoting the luminance level of a pixel in, e.g., eight bits based on this video signal to supply this sequence as a pixel data signal PDS to the source driver 3.

The scan driver 2 generates horizontal scan pulses synchronous with the above horizontal synchronizing signal to apply them sequentially, respectively to the scan lines $S_1$ to $S_m$ of the display device 20.

The source driver 3 is formed on, e.g., a semiconductor chip and takes in the sequence of pixel data PD in the pixel data signal PDS. Each time that one horizontal scan line worth of, i.e., n number of pixel data PD, where n is the total number of the source lines, are taken in, the source driver 3 converts the n number of pixel data PD taken in into pixel drive voltages having voltage values corresponding to the respective luminance levels denoted by them to apply to the source lines $D_1$ to $D_n$ of the display device 20.

Figure 2:
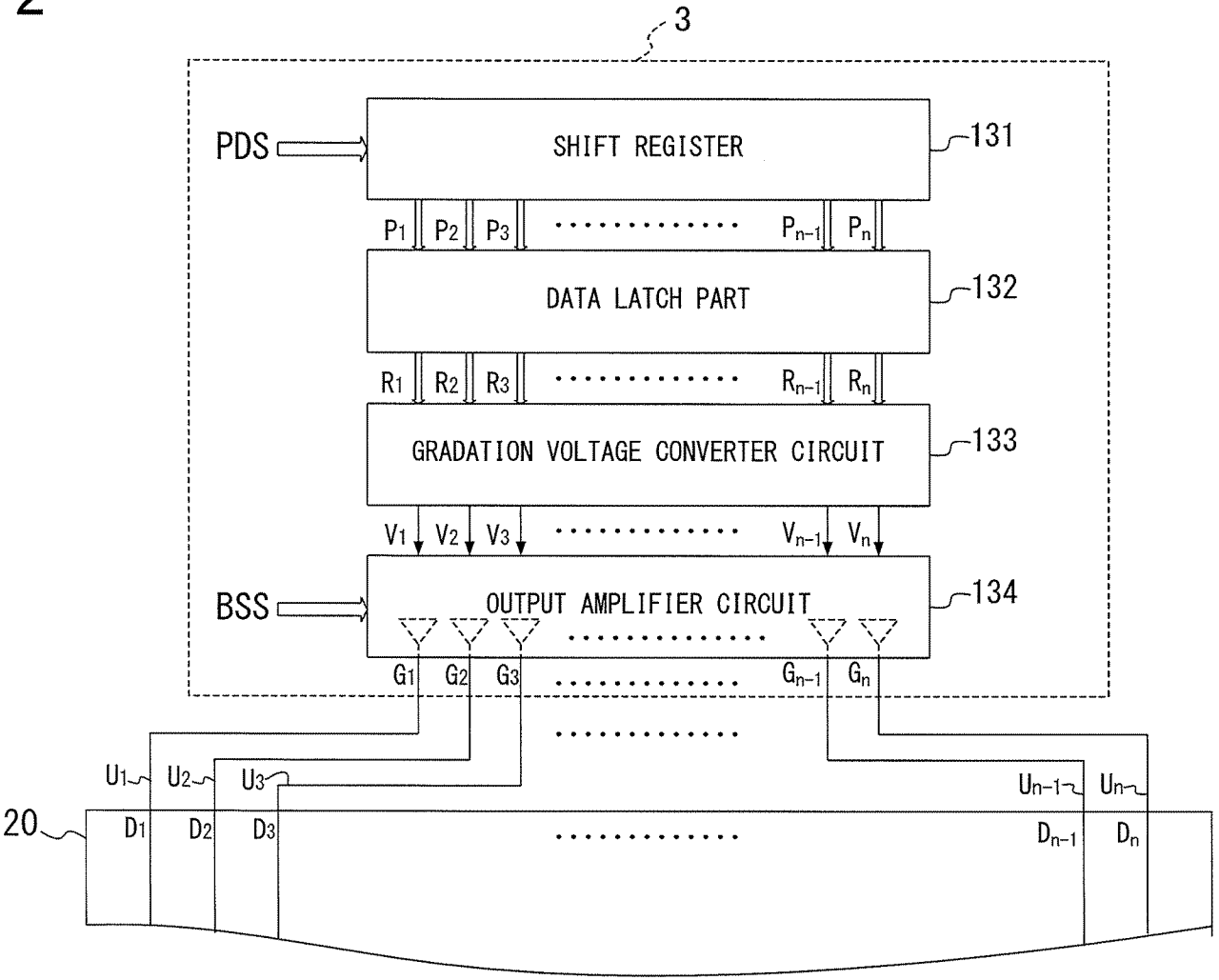
FIG. 2 is a block diagram showing the internal configuration of a source driver 3.

FIG. 2 is a block diagram showing the internal configuration of the source driver 3. As shown in FIG. 2, the source driver 3 includes a shift register 131, a data latch part 132, a gradation voltage converter circuit 133, and an output amplifier circuit 134.

The shift register 131 takes in the sequence of pixel data PD from the pixel data signal PDS supplied from the drive control part 1 to supply one horizontal scan line worth (n number) of pixel data PD as pixel data $P_1$ to $P_n$ to the data latch part 132.

The data latch part 132 takes in the pixel data $P_1$ to $P_n$ to supply them as pixel data $R_1$ to $R_n$ to the gradation voltage converter circuit 133.

The gradation voltage converter circuit 133 converts the above pixel data $R_1$ to $R_n$ to pixel drive voltages $V_1$ to $V_n$ having voltage values corresponding to their respective luminance levels to supply to the output amplifier circuit 134. The output amplifier circuit 134 applies the pixel drive voltages $V_1$ to $V_n$ amplified to a desired level, as pixel drive voltages $G_1$ to $G_n$, to the source lines $D_1$ to $D_n$ of the display device respectively. The output amplifier circuit 134 is put in a bias voltage set mode, that is, one of a V-slew mode, an R-slew mode, and an L-slew mode described later, which is designated by a bias supply line setting signal BSS supplied from the drive control part 1.

In the case where the source driver 3 having a chip size smaller than the lateral width of the display device 20 is placed along one side of the display device 20 and on the middle of the side as shown in FIGS. 1 and 2, as to the lengths of external lines $U_1$ to $U_n$ connecting the output amplifier circuit 134 and the source lines $D_1$ to $D_n$, those on the middle of the side of the display device 20 are the shortest, and, when going toward either end, those become longer. For example, where n is an even number, in the example shown in FIG. 1, from among the external lines $U_1$ to $U_n$, the lengths of the external lines $U_Q$ and $U_{Q+1}$ (Q=n/2) placed on the middle are the shortest, and the lengths of the external lines $U_1$ and $U_n$ placed in both ends are the longest. Accordingly, as to the values of the wiring resistances of $U_1$ to $U_n$, those on the middle of the side of the display device 20 are smaller, and, when going toward either end, those become greater. Thus, as to the transmission delays on the external lines $U_1, U_2, \ldots, U_Q, U_{Q+1}, \ldots, U_{n-1}, U_n$, that on $U_1$ ($U_n$) is the largest, and the transmission delay decreases in the order of $U_2$ ($U_{n-1}$), $U_3$ ($U_{n-2}$), . . . , $U_Q$ ($U_{Q-1}$).

Where n is an odd number, from among the external lines $U_1$ to $U_n$, the length (wiring length) of the external line $U_Q$ (Q=(n+1)/2) placed on the middle is the shortest, and the lengths of the external lines $U_1$ and $U_n$ placed in both ends are the longest. Thus, as to the transmission delays on the external lines $U_1, U_2, \ldots, U_{Q-1}, U_Q, U_{Q+1}, \ldots, U_{n-1}, U_n$, that on $U_1$ ($U_n$) is the largest, and the transmission delay decreases in the order of $U_2$ ($U_{n-1}$), $U_3$ ($U_{n-2}$), . . . , $U_{Q-1}$ ($U_{Q+1}$), $U_Q$.

Figure 3:
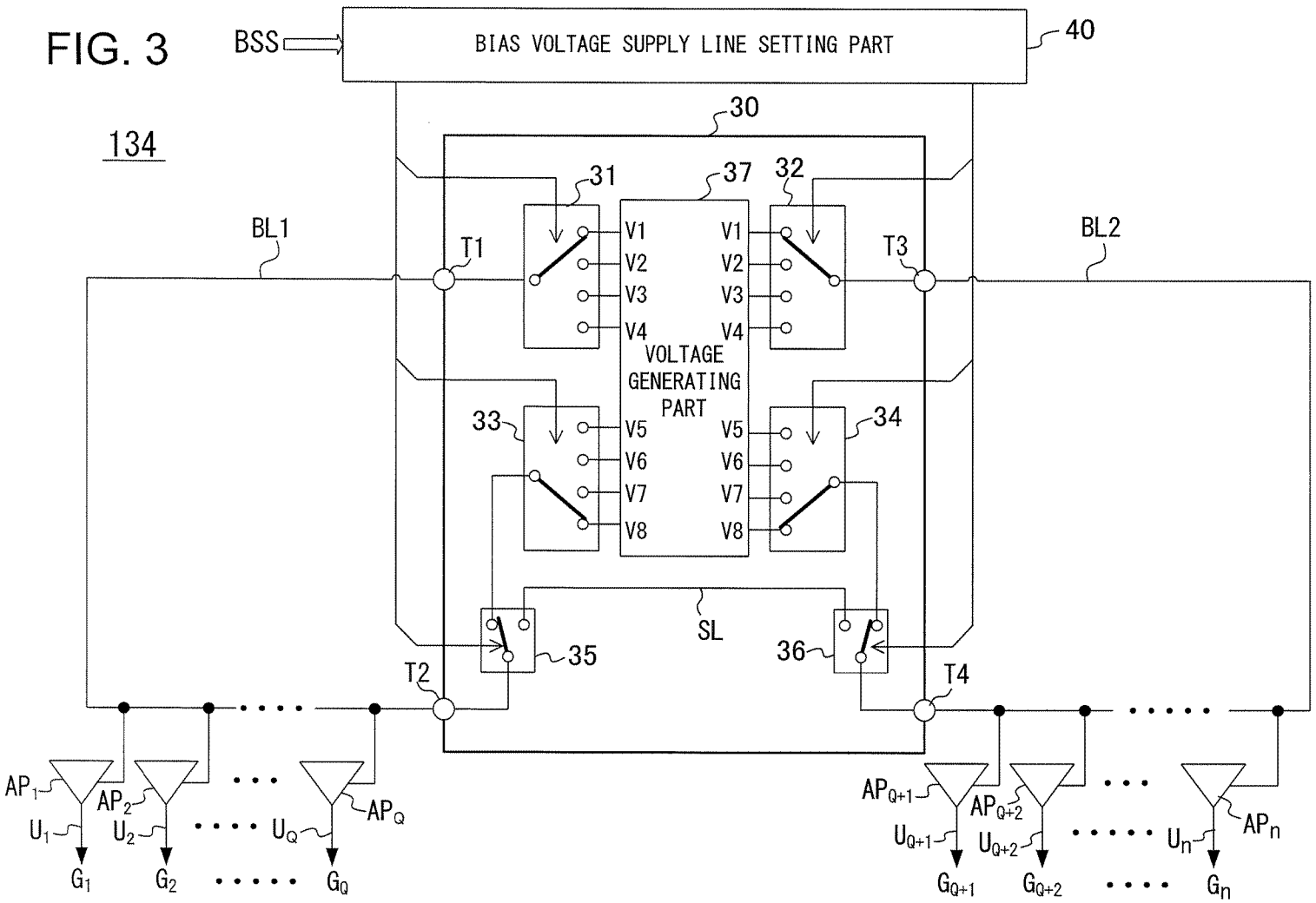
FIG. 3 is a diagram showing the internal configuration of an output amplifier circuit 134.

FIG. 3 is a block diagram showing the internal configuration of the output amplifier circuit 134. As shown in FIG. 3, the output amplifier circuit 134 has a bias voltage generating part 30, a bias voltage supply line setting part 40, and amplifiers $AP_1$ to $AP_n$ respectively corresponding to the source lines $D_1$ to $D_n$. The bias voltage generating part 30 and the amplifiers $AP_1$ to $AP_n$ are connected by bias voltage supply lines BL1 and BL2.

The amplifiers $AP_1$ to $AP_n$ are arranged in a line along the side thereof in the semiconductor chip. The amplifiers $AP_1$ to $AP_n$ are constituted by, e.g., operational amplifiers and apply the pixel drive voltages $G_1$ to $G_n$ respectively obtained by amplifying the pixel drive voltages $V_1$ to $V_n$ supplied from the gradation voltage converter circuit 133 to the source lines $D_1$ to $D_n$ of the display device 20 via the external lines $U_1$ to $U_n$ respectively. A bias voltage input terminal (a control terminal), via which to input a bias voltage to control current flowing through the differential stage of the operational amplifier, i.e., internal operating current, is provided in each of the amplifiers $AP_1$ to $AP_n$. Hence, individually for each of the amplifiers $AP_1$ to $AP_n$, the internal operating current is adjusted through the bias voltage supplied to the bias voltage input terminal. The higher the bias voltage supplied to the bias voltage input terminal is, the larger the internal operating current is, and thus the amplifier AP operates at higher speed (with higher transition speed), so that its output delay becomes smaller.

The bias voltage supply line setting part 40 switches the connection of switches 31 to 36 formed in the bias voltage generating part 30 according to the bias voltage set mode designated by the bias supply line setting signal BSS.

The bias voltage generating part 30 generates various bias voltages to control the internal operating current of each of the amplifiers $AP_1$ to $AP_n$ and supplies these to the respective bias voltage input terminals of the $AP_1$ to $AP_n$ via the bias voltage supply lines BL1 and BL2.

As shown in FIG. 3, the bias voltage generating part 30 includes the switches 31 to 36, a voltage generating unit 37, and terminals T1 to T4 via which to output bias voltages.

The voltage generating part 37 generates voltages V1 to V8 which have a magnitude relation that, e.g., V1>V2>V3>V4>V5>V6>V7>V8 and supplies the voltages V1 to V4 of them to each of the switches 31 and 32 and the voltages V5 to V8 to each of the switches 33 and 34.

The switch 31 selects one of the voltages V1 to V4 according to a switch switching signal supplied from the bias voltage supply line setting part 40 to apply the selected voltage onto the terminal T1.

The switch 32 selects one of the voltages V1 to V4 according to a switch switching signal supplied from the bias voltage supply line setting part 40 to apply the selected voltage onto the terminal T3.

The switch 33 selects one of the voltages V5 to V8 according to a switch switching signal supplied from the bias voltage supply line setting part 40 to supply the selected voltage to the switch 35.

The switch 34 selects one of the voltages V5 to V8 according to a switch switching signal supplied from the bias voltage supply line setting part 40 to supply the selected voltage to the switch 36.

The switch 35 applies one of the voltage supplied from the switch 33 and a voltage supplied via a short line SL onto the terminal T2 according to a switch switching signal supplied from the bias voltage supply line setting part 40.

The switch 36 applies one of the voltage supplied from the switch 34 and a voltage supplied via the short line SL onto the terminal T4 according to a switch switching signal supplied from the bias voltage supply line setting part 40.

As shown in FIG. 3, the terminal T1 of the bias voltage generating part 30 is connected to one end of the bias voltage supply line BL1, and the terminal T2 of the bias voltage generating part 30 is connected to the other end of the BL1. Further, the respective bias voltage input terminals of the $AP_1$ to $AP_Q$ (a first amplifier group) placed in the left region from among the amplifiers $AP_1$ to $AP_n$ are connected to the bias voltage supply line BL1. Note that as to the lengths (wiring lengths) of the bias voltage supply line BL1 from the terminal T1 to the respective bias voltage input terminals of the $AP_1$ to $AP_Q$, that for $AP_Q$ is the longest, and the length decreases in the order of $AP_{Q-1}, \ldots, AP_2, AP_1$.

Further, as shown in FIG. 3, the terminal T3 of the bias voltage generating part 30 is connected to one end of the bias voltage supply line BL2, and the terminal T4 of the bias voltage generating part 30 is connected to the other end of the BL2. The respective bias voltage input terminals of the $AP_{Q+1}$ to $AP_n$ (a second amplifier group) placed in the right region from among the amplifiers $AP_1$ to $AP_n$ are connected to the bias voltage supply line BL2. Note that as to the lengths of the bias voltage supply line BL2 from the terminal T3 to the respective bias voltage input terminals of the $AP_{Q+1}$ to $AP_n$, that for $AP_{Q+1}$ is the longest, and the length decreases in the order of $AP_{Q+2}, AP_{Q+3}, \ldots, AP_{n-2}, AP_{n-1}, AP_n$.

As described above, the bias voltage supply lines BL1 and BL2 are connected to the control terminal of the respective one of the amplifiers $AP_1$ to $AP_n$ so that the respective length from the either one end of the bias voltage supply lines BL1 and BL2 to the respective control terminal of the amplifiers $AP_1$ to $AP_n$ correspond in length to the external line $U_1$ to $U_n$ connected to the respective one of the amplifier $AP_1$ to $AP_n$.

The supply of bias voltages via the bias voltage supply lines BL1 and BL2 shown in FIG. 3 will be described below.

First, in the example shown in FIG. 1, since the source driver 3 is placed on the middle of one side of the display device 20, the drive control part 1 supplies the bias supply line setting signal BSS designating the V-slew mode (first mode) to the bias voltage supply line setting part 40. The bias voltage supply line setting part 40, according to this bias supply line setting signal BSS designating the V-slew mode, supplies switch switching signals to the bias voltage generating part 30 to apply, e.g., the largest voltage V1 as a bias voltage to each of the terminals T1 and T3 as first terminals and to apply the voltage V8 smaller than the voltage V1 to the terminals T2 and T4 as second terminals. Thus, the switch 31 applies the voltage V1 as a bias voltage onto the bias voltage supply line BL1 via the terminal T1. The switch 32 applies the voltage V1 as a bias voltage onto the bias voltage supply line BL2 via the terminal T3. The switches 33 and 35 applies the voltage V8 onto the bias voltage supply line BL1 via the terminal T2. The switches 34 and 36 applies the voltage V8 onto the bias voltage supply line BL2 via the terminal T4.

Thus, in the V-slew mode, because the potential on the terminal T1 is at V1 and higher than the potential V8 on the terminal T2, a current flows in the direction from the terminal T1 toward the terminal T2 via the bias voltage supply line BL1. Also, because the potential on the terminal T3 is at V1 and higher than the potential V8 on the terminal T4, a current flows in the direction from the terminal T3 toward the terminal T4 via the bias voltage supply line BL2.

As described above, the lengths of the bias voltage supply line BL1 from the terminal T1 to the respective bias voltage input terminals of the $AP_1$ to $AP_Q$ are ranked from longest in the order of $AP_Q, AP_{Q-1}, \ldots, AP_2, AP_1$. Accordingly, the wiring resistances are also ranked from highest in the order of $AP_Q, AP_{Q-1}, \ldots, AP_2, AP_1$. Thus, the bias voltage supplied to each amplifier is, in a sense, a voltage divided according to the wiring resistance of the bias voltage supply line BL1; the bias voltage having the largest voltage value is supplied to $AP_1$; and the bias voltage supplied to AP decreases in the order of $AP_2, AP_3, \ldots, AP_{Q-1}, AP_Q$.

According to these bias voltages, as to the output delays of $AP_1$ to $AP_Q$, that of $AP_1$ is the smallest, and the output delay increases in the order of $AP_2, AP_3, \ldots, AP_{Q-1}, AP_Q$. Meanwhile, as to the transmission delays on the external lines $U_1$ to $U_Q$ respectively connected to the amplifiers $AP_1$ to $AP_Q$, that on the external line $U_1$ is the largest, and the transmission delay decreases in the order of $U_1, U_2, \ldots, U_{Q-1}, U_Q$ as mentioned previously. Therefore, the application timings of the pixel drive voltages $G_1$ to $G_Q$ that are applied to the source lines $D_1$ to $D_Q$ via the amplifiers $AP_1$ to $AP_Q$ and the external lines $U_1$ to $U_Q$ respectively become the same. That is, the bias voltage supply line BL1 is laid out in such a way that the respective lengths thereof from the terminal T1 to the $AP_1$ to $AP_Q$ are ranked from longest to shortest in the order of $AP_Q, AP_{Q-1}, \ldots, AP_2, AP_1$ so that a higher bias voltage is supplied to the amplifier AP connected to the external line U having a longer length.

As such, by making the output delay of the amplifier AP connected to the external line U having a longer length smaller, the differences between the transmission delays on the external lines $U_1$ to $U_Q$ are reduced. With this configuration, over the left region of the two-dimensional screen that the source lines $D_1$ to $D_Q$ are in charge of, image display of high quality without display unevenness can be performed. Further, in the configuration shown in FIG. 3, different bias voltages are supplied by voltage division using the wiring resistance of the bias voltage supply line BL1 to the amplifiers $AP_1$ to $AP_Q$ respectively, and hence the area occupied by the output amplifier circuit in the chip can be reduced as compared with the case where a dedicated bias voltage supply line is provided for each amplifier AP to supply a bias voltage thereto individually.

Meanwhile, the lengths of the bias voltage supply line BL2 from the terminal T3 to the respective bias voltage input terminals of the $AP_{Q+1}$ to $AP_n$ are ranked from longest in the order of $AP_{Q+1}$, $AP_{Q+2}$, . . . , $AP_{n-2}$, $AP_{n-1}$, APn. Accordingly, the wiring resistances are also ranked from highest in the order of $AP_{Q+1}$, $AP_{Q+2}$, . . . , $AP_{n-2}$, $AP_{n-1}$, APn. Thus, the bias voltage supplied to each amplifier is, in a sense, a voltage divided according to the wiring resistance of the bias voltage supply line BL2; the bias voltage having the largest voltage value is supplied to $AP_n$; and the bias voltage supplied to AP decreases in the order of $AP_{n-1}$, $AP_{n-2}$, . . . , $AP_{Q+2}$, $AP_{Q+1}$.

According to these bias voltages, as to the output delays of $AP_{Q+1}$ to $AP_n$, that of $AP_n$ is the smallest, and the output delay increases in the order of $AP_{n-1}$, $AP_{n-2}$, . . . , $AP_{Q+2}$, $AP_{Q+1}$. Meanwhile, as to the transmission delays on the external lines $U_{Q+1}$ to $U_n$ respectively connected to the amplifiers $AP_{Q+1}$ to $AP_n$, that on the external line $U_n$ is the largest, and the transmission delay decreases in the order of $U_{n-1}$, $U_{n-2}$, . . . , $U_{Q+2}$, $U_{Q+1}$ as mentioned previously.

Therefore, the application timings of the pixel drive voltages $G_{Q+1}$ to $G_n$ that are applied to the source lines $D_{Q+1}$ to $D_n$ via the amplifiers $AP_{Q+1}$ to $AP_n$ and the external lines $U_{Q+1}$ to $U_n$ respectively become the same. That is, the bias voltage supply line BL2 is laid out in such a way that the respective lengths thereof from the terminal T3 to the $AP_{Q+1}$ to $AP_n$ are ranked from longest to shortest in the order of $AP_{Q+1}$, $AP_{Q+2}$, . . . , $AP_{n-2}$, $AP_{n-1}$, $AP_n$ so that a higher bias voltage is supplied to the amplifier AP connected to the external line U having a longer length.

As such, by making the output delay of the amplifier AP connected to the external line U having a longer length smaller, the differences between the transmission delays on the external lines $U_{Q+1}$ to $U_n$ are reduced. With this configuration, over the right region of the two-dimensional screen that the source lines $D_{Q+1}$ to $D_n$ are in charge of, image display of high quality without display unevenness can be performed. Further, in the configuration shown in FIG. 3, different bias voltages are supplied by voltage division using the wiring resistance of the bias voltage supply line BL2 to the amplifiers $AP_{Q+1}$ to $AP_n$ respectively, and hence the area occupied by the output amplifier circuit in the chip can be reduced as compared with the case where a dedicated bias voltage supply line is provided for each amplifier AP to supply a bias voltage thereto individually.

As described above, in the output amplifier circuit 134 shown in FIG. 3, in forming the bias voltage supply lines in order to supply the bias voltages generated by the bias voltage generating part 30 respectively to the amplifiers $AP_1$ to $AP_n$ via the first terminals (T1, T3) and the bias voltage supply lines (BL1, BL2), the bias voltage supply lines are laid out in such a way that the longer the length of the external line ($U_1$ to $U_n$) connected to any of the amplifiers is, the shorter the length thereof from the first terminal to the amplifier is. With this configuration, the respective application timings of the pixel drive voltages $G_1$ to $G_n$ that are applied to the source lines $D_1$ to $D_n$ via the amplifiers $AP_1$ to $AP_n$ and the external lines $U_1$ to $U_n$ respectively become the same, so that image display of high quality without display unevenness is performed.

Figure 4:
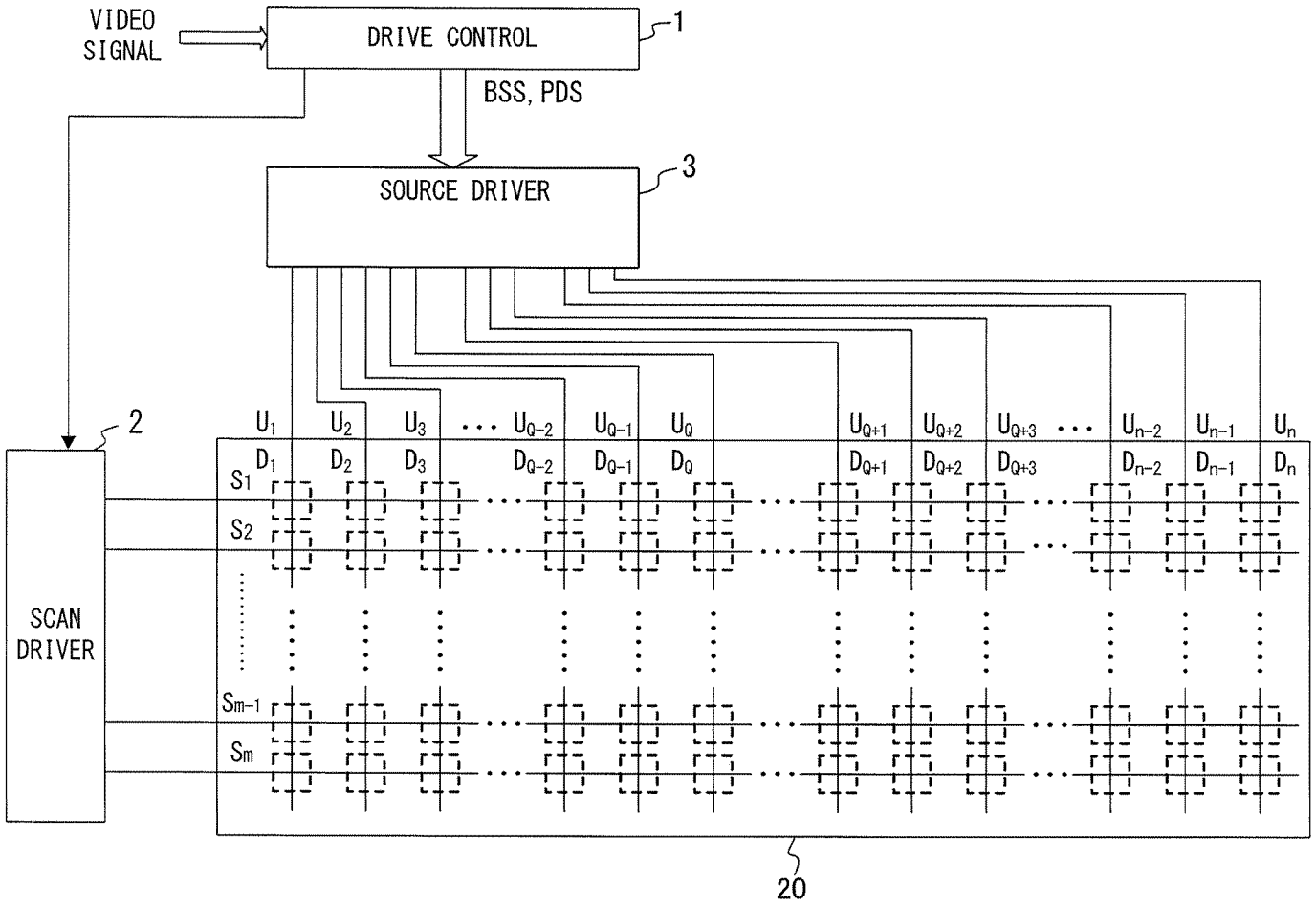
FIG. 4 is a block diagram showing another example of the display apparatus including the driving device according to the present invention.

Although the above embodiment describes an example of the case where the source driver 3 having a chip size smaller than the lateral width of the display device 20 is placed on the middle of one side of the display device 20, the position of the source driver is not limited to this. For example, as shown in FIGS. 4 and 5, the source driver 3 may be placed along the left end side of one side of the display device 20.

Figure 5:
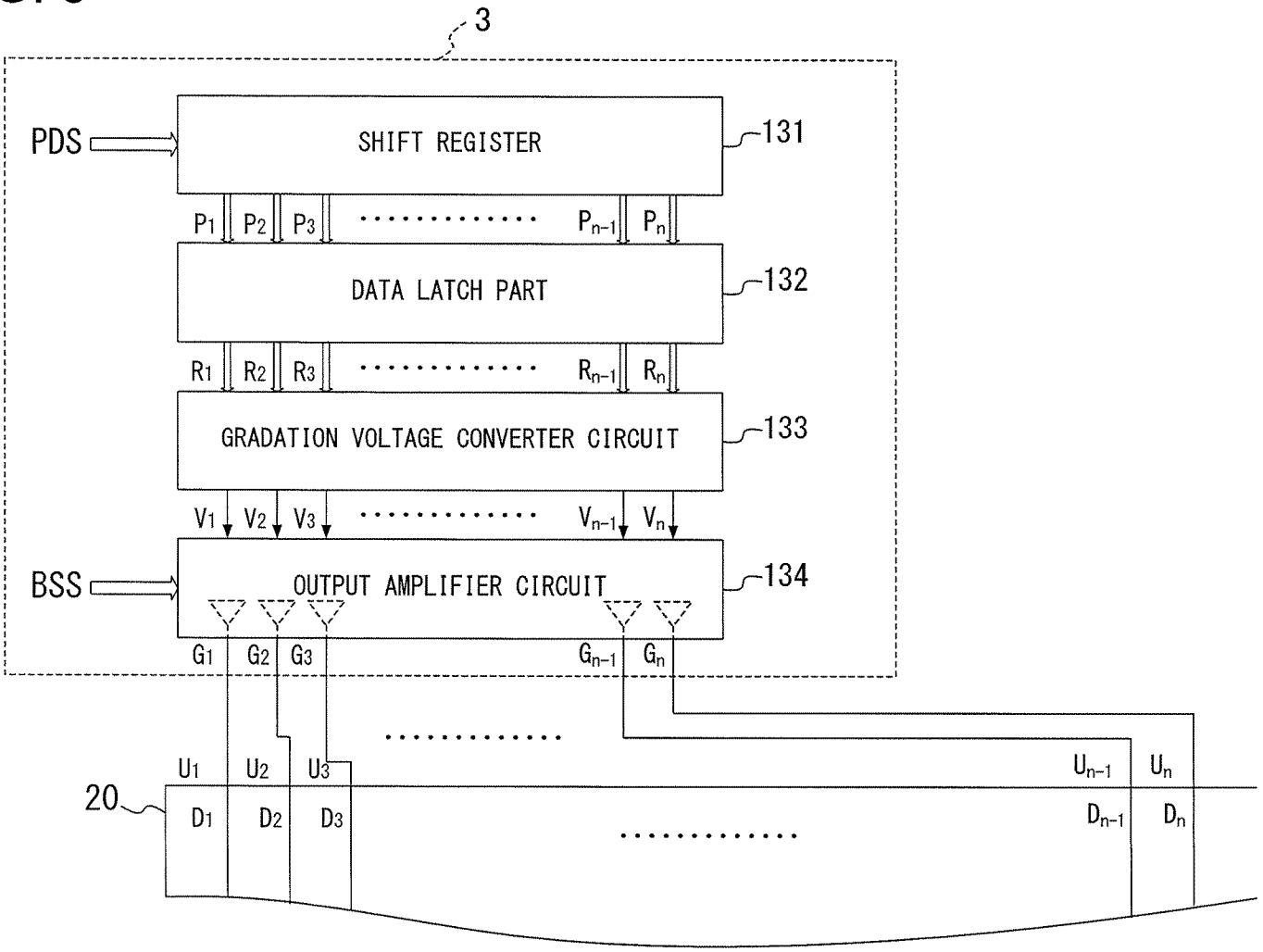
FIG. 5 is a block diagram showing another example of the internal configuration of the source driver 3.

In this case, as shown in FIG. 5, as to the lengths of the external lines $U_1$ to $U_n$ connecting the output amplifier circuit 134 and the source lines $D_1$ to $D_n$, that of the external line located at the left end of one side of the display device 20 is the shortest, and when going toward the right end, the length of the external line becomes longer. In an example shown in FIG. 4, from among the external lines $U_1$ to $U_n$, the external line $U_1$ placed at the left end is the shortest in length, and the external line $U_n$ placed at the right end is the longest in length. Thus, also as to the wiring resistances of $U_1$ to $U_n$, that of the external line located at the left end of one side of the display device 20 is smaller, and when going toward the right end, the wire resistance of the external line becomes larger. Therefore, as to the transmission delays on the external lines $U_1$ to $U_n$, that on $U_n$ is the largest, and the transmission delay decreases in the order of $U_{n-1}$, $U_{n-2}$, . . . , $U_3$, $U_2$, $U_1$.

As such, where the source driver 3 is located along the left end side of the display device 20, the drive control part 1 supplies the bias supply line setting signal BSS designating the R-slew mode (second mode) to the bias voltage supply line setting part 40.

The bias voltage supply line setting part 40, according to this bias supply line setting signal BSS designating the R-slew mode, supplies switch switching signals to the bias voltage generating part 30 to apply, e.g., the largest voltage V1 as a bias voltage to the terminal T3 as the first terminal and to apply the voltage V4 smaller than the voltage V1 to the terminal T1 as the second terminal. Further, the bias voltage supply line setting part 40 supplies switch switching signals to short-circuit the terminals T2 and T4 to the bias voltage generating part 30.

Thus, the switch 32 applies the voltage V1 as a bias voltage onto the bias voltage supply line BL2 via the terminal T3. The switch 31 applies the voltage V4 onto the bias voltage supply line BL1 via the terminal T1. The switches 35 and 36 short-circuits the terminals T2 and T4 via a short line SL.

Thus, in the R-slew mode, because the potential on the terminal T3 is at V1 and higher than the potential V4 on the terminal T1, a current flows in the direction from the terminal T3 via the terminals T4 and T2 toward the terminal T1 via the bias voltage supply line BL2, the short line SL, and the bias voltage supply line BL1.

The lengths of the bias voltage supply line (BL2, SL, BL1) from the terminal T3 to the respective bias voltage input terminals of the $AP_1$ to $AP_n$ are ranked from longest in the order of $AP_1$, $AP_2$, . . . , $AP_{n-1}$, $AP_n$. Accordingly, the wiring resistances are also ranked from highest in the order of $AP_1$, $AP_2$, . . . , $AP_{n-1}$, $AP_n$.

Thus, the bias voltage supplied to each amplifier is, in a sense, a voltage divided according to the wiring resistance of the bias voltage supply line BL2, the short line SL, and the bias voltage supply line BL1; the bias voltage having the largest voltage value is supplied to $AP_n$; and the bias voltage supplied to AP decreases in the order of $AP_{n-1}$, $AP_{n-2}$, . . . , $AP_2$, $AP_1$. According to these bias voltages, as to the output delays of $AP_1$ to $AP_n$, that of $AP_n$ is the smallest, and the output delay increases in the order of $AP_{n-1}$, $AP_{n-2}$, . . . , $AP_2$, $AP_1$. Meanwhile, as to the transmission delays on the external lines $U_1$ to $U_n$ respectively connected to the amplifiers $AP_1$ to $AP_n$, that on the external line $U_n$ is the largest, and the transmission delay decreases in the order of $U_{n-1}$, $U_{n-2}$, . . . , $U_2$, $U_1$ as mentioned previously.

Therefore, the application timings of the pixel drive voltages $G_1$ to $G_n$ that are applied to the source lines $D_1$ to $D_n$ via the amplifiers $AP_1$ to $AP_n$ and the external lines $U_1$ to $U_n$ respectively become the same. That is, the bias voltage supply lines BL1 and BL2 are laid out in such a way that the respective lengths thereof from the terminal T3 to the $AP_1$ to $AP_n$ are ranked from longest to shortest in the order of $AP_1$, $AP_2$, . . . , $AP_{n-2}$, $AP_{n-1}$, $AP_n$ so that a higher bias voltage is supplied to the amplifier AP connected to the external line U having a longer length.

As such, by making the output delay of the amplifier AP connected to the external line U having a longer length smaller, the differences between the transmission delays on the external lines $U_1$ to $U_n$ are reduced. With this configuration, over the entire region of the two-dimensional screen that the source lines $D_1$ to $D_n$ are in charge of, image display of high quality without display unevenness can be performed.

Figure 6:
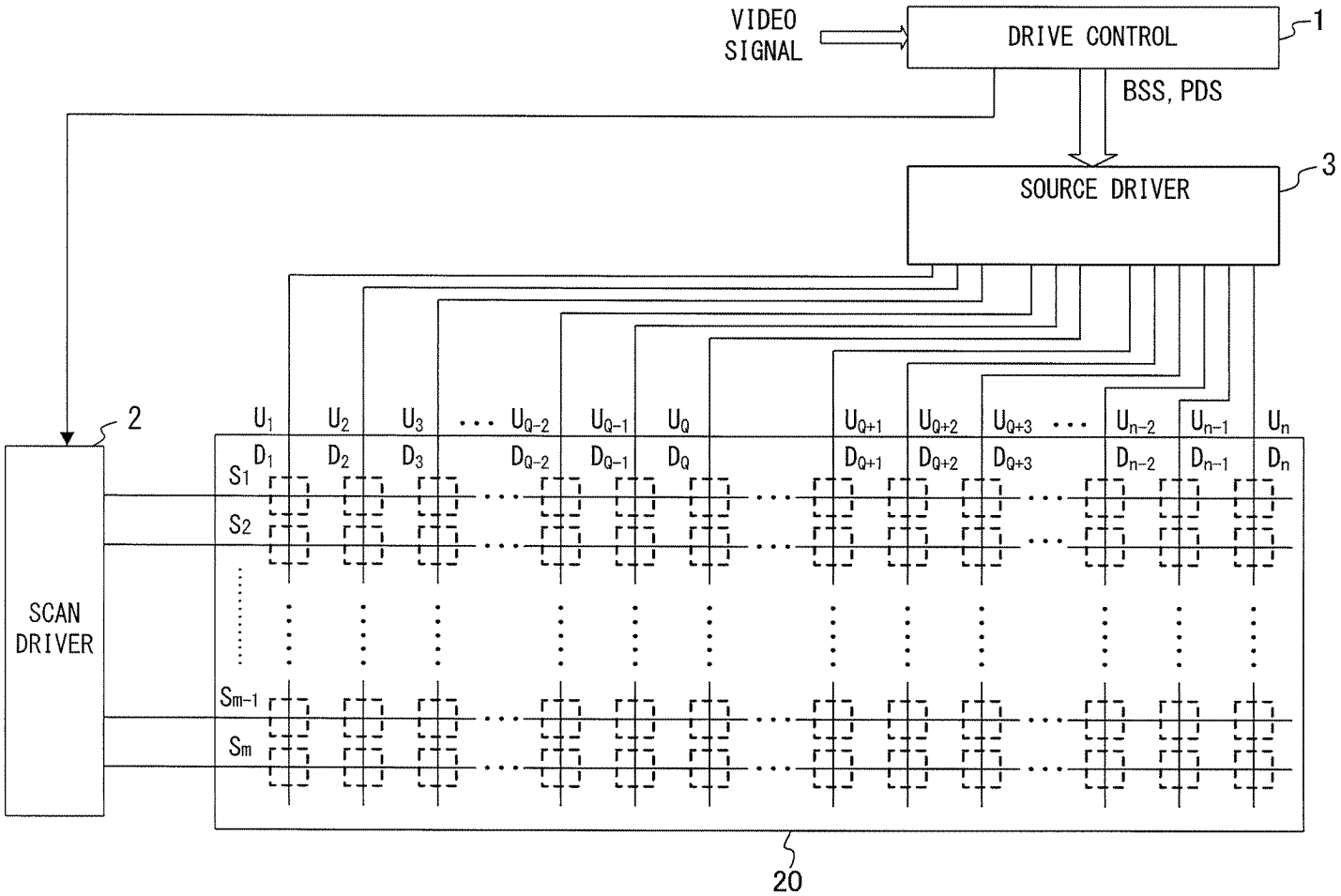
FIG. 6 is a block diagram showing another example of the display apparatus including the driving device according to the present invention.
Figure 7:
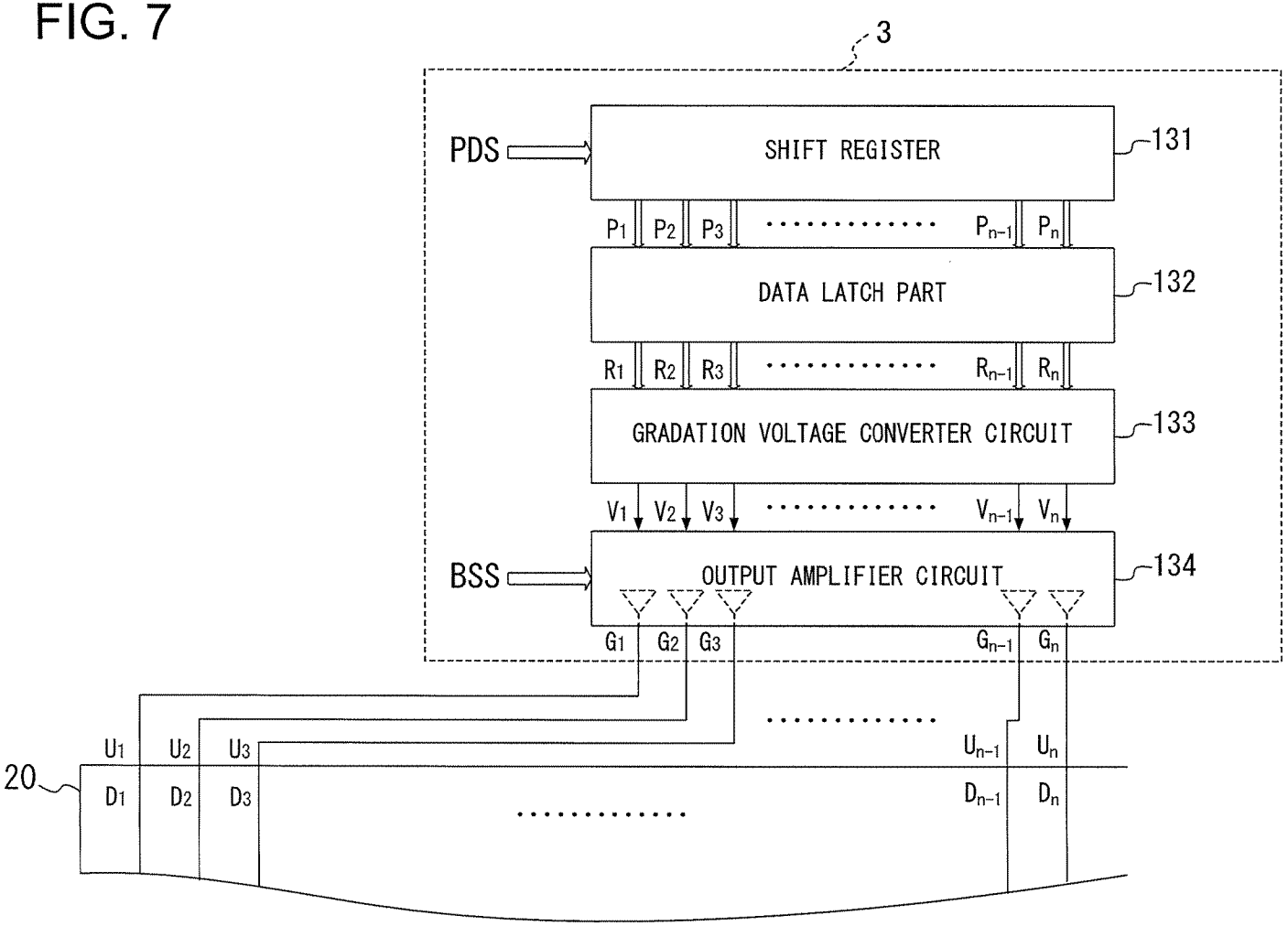
FIG. 7 is a block diagram showing another example of the internal configuration of the source driver 3.

Or, as shown in FIGS. 6 and 7, the source driver 3 may be placed along the right end side of the display device 20. In this case, as shown in FIG. 6, as to the lengths of the external lines $U_1$ to $U_n$ connecting the output amplifier circuit 134 and the source lines $D_1$ to $D_n$, that of the external line located at the right end of one side of the display device 20 is the shortest, and when going toward the left end, the length of the external line becomes longer. In an example shown in FIG. 6, from among the external lines $U_1$ to $U_n$, the external line $U_n$ placed at the right end is the shortest in length, and the external line $U_1$ placed at the left end is the longest in length. Thus, also as to the wiring resistances of $U_1$ to $U_n$, that of the external line located at the right end of one side of the display device 20 is smaller, and when going toward the left end, the wire resistance of the external line becomes larger. Therefore, as to the transmission delays on the external lines $U_1$ to $U_n$, that on $U_1$ is the largest, and the transmission delay decreases in the order of $U_2$, $U_3$, . . . , $U_{n-1}$, Un.

As such, where the source driver 3 is located along the right end side of the display device 20, the drive control part 1 supplies the bias supply line setting signal BSS designating the L-slew mode (third mode) to the bias voltage supply line setting part 40.

The bias voltage supply line setting part 40, according to this bias supply line setting signal BSS designating the L-slew mode, supplies switch switching signals to the bias voltage generating part 30 to apply, e.g., the largest voltage V1 as a bias voltage to the terminal T1 as the first terminal and to apply the voltage V4 smaller than the voltage V1 to the terminal T3 as the second terminal. Further, the bias voltage supply line setting part 40 supplies switch switching signals to short-circuit the terminals T2 and T4 to the bias voltage generating part 30. Thus, the switch 32 applies the voltage V4 onto the bias voltage supply line BL2 via the terminal T3. The switch 31 applies the voltage V1 as a bias voltage onto the bias voltage supply line BL1 via the terminal T1. The switches 35 and 36 short-circuits the terminals T2 and T4 via the short line SL.

Thus, in the L-slew mode, because the potential on the terminal T1 is at V1 and higher than the potential V4 on the terminal T3, a current flows in the direction from the terminal T1 via the terminals T2 and T4 toward the terminal T3 via the bias voltage supply line BL1, the short line SL, and the bias voltage supply line BL2.

The lengths of the bias voltage supply line (BL1, SL, BL2) from the terminal T1 to the respective bias voltage input terminals of the $AP_1$ to $AP_n$ are ranked from longest in the order of $AP_n$, $AP_{n-1}$, . . . , $AP_2$, $AP_1$. Accordingly, the wiring resistances are also ranked from highest in the order of $AP_n$, $AP_{n-1}$, . . . , $AP_2$, $AP_1$.

Thus, the bias voltage supplied to each amplifier is, in a sense, a voltage divided according to the wiring resistance of the bias voltage supply line BL1, the short line SL, and the bias voltage supply line BL2; the bias voltage having the largest voltage value is supplied to $AP_1$; and the bias voltage supplied to AP decreases in the order of $AP_2$, $AP_3$, . . . , $AP_{n-1}$, $AP_n$. According to these bias voltages, as to the output delays of $AP_1$ to $AP_n$, that of $AP_1$ is the smallest, and the output delay increases in the order of $AP_2$, $AP_3$, . . . , $AP_{n-1}$, $AP_n$. Meanwhile, as to the transmission delays on the external lines $U_1$ to $U_n$ respectively connected to the amplifiers $AP_1$ to $AP_n$, that on the external line $U_1$ is the largest, and the transmission delay decreases in the order of $U_2$, $U_3$, . . . , $U_{n-1}$, $U_n$ as mentioned previously.

Therefore, the application timings of the pixel drive voltages $G_1$ to $G_n$ that are applied to the source lines $D_1$ to $D_n$ via the amplifiers $AP_1$ to $AP_n$ and the external lines $U_1$ to $U_n$ respectively become the same. That is, the bias voltage supply lines BL1 and BL2 are laid out in such a way that the respective lengths thereof from the terminal T1 to the $AP_1$ to $AP_n$ are ranked from longest to shortest in the order of $AP_n$, $AP_{n-1}$, . . . , $AP_3$, $AP_2$, $AP_1$ so that a higher bias voltage is supplied to the amplifier AP connected to the external line U having a longer length.

As such, by making the output delay of the amplifier AP connected to the external line U having a longer length smaller, the differences between the transmission delays on the external lines $U_1$ to $U_n$ are reduced. With this configuration, over the entire region of the two-dimensional screen that the source lines $D_1$ to $D_n$ are in charge of, image display of high quality without display unevenness can be performed.

Although in the above embodiment, in the V-slew mode, the potentials on the terminals T3 and T1 are set at V1, and the potentials on the terminals T4 and T2 are set at V8, not being limited to this, the potentials on the terminals can be set according to the differences between the transmission delays as needed. Where the differences between the transmission delays are small, for example, by setting the potentials on the terminals T3 and T1 at V4 and the potentials on the terminals T4 and T2 at V5, the differences between the output delays of the amplifiers are made smaller, so that image unevenness can be suppressed more precisely. Likewise, also in the R-slew mode and L-slew mode, by setting the potentials on the terminals T3 and T1 according to the differences between the transmission delays as needed, image unevenness can be suppressed more precisely.

Where the voltage generating part 37 cannot generate desired bias voltages in the V-slew mode, a bias voltage amplifier may be provided to amplify bias voltages which the voltage generating part 37 applies to the terminals T3 and T4.

Figure 8:
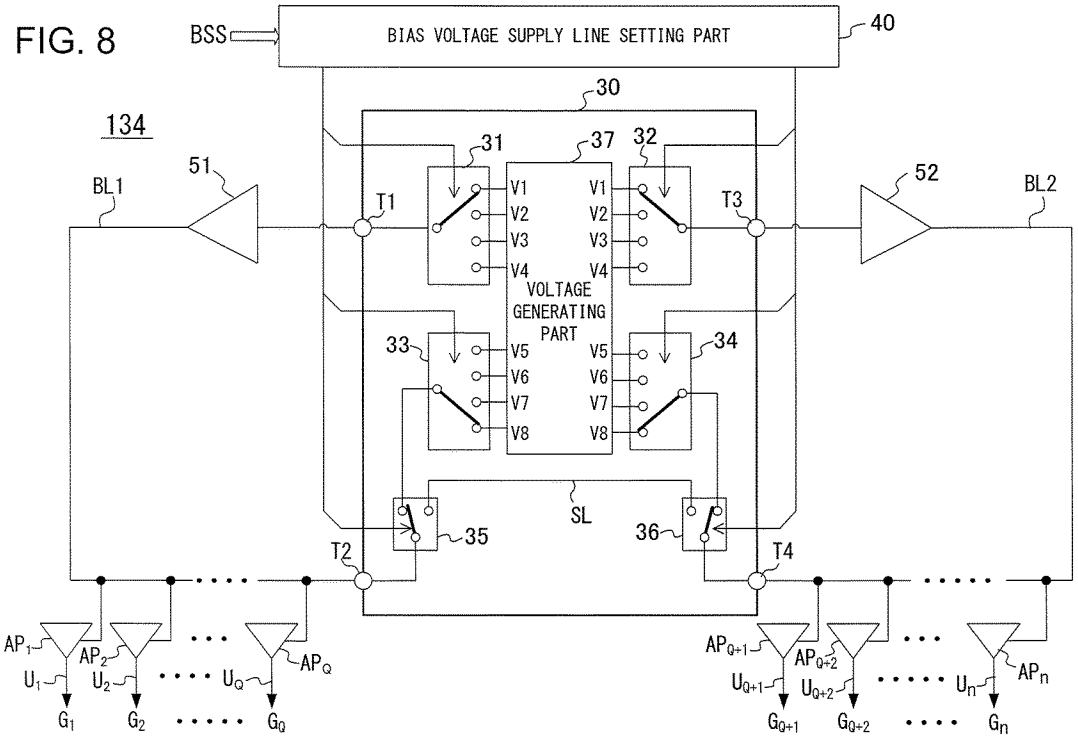
FIG. 8 is a diagram showing another example of the output amplifier circuit 134.

For example, as shown in FIG. 8, a first bias voltage amplifier 52 is provided between the bias voltage supply line BL2 and the terminal T3, and a second bias voltage amplifier 51 is provided between the bias voltage supply line BL1 and the terminal T1.

To sum up, the first and second bias voltage supply lines BL1 and BL2 are laid out in such a way that the longer the length of the external line U connected to any of the amplifiers AP belonging to the $AP_{Q+1}$ to $AP_n$ (the first amplifier group) and the $AP_1$ to $AP_Q$ (the second amplifier group) is, the shorter the length of the BL1 and BL2 from the terminal to which a bias voltage is applied from among the first and third terminals to the amplifier is.

This application is based on a Japanese Patent application No. 2014-042363 which is hereby incorporated by reference.

What is claimed is:

1. A driving device for driving a display device, comprising:

a source driver that applies pixel drive voltages respectively denoting luminance levels of pixels to a plurality of source lines of the display device via external lines respectively, wherein said source driver includes:

a plurality of amplifiers provided correspondingly to the plurality of source lines respectively and configured to generate said pixel drive voltages, each of the plurality of amplifiers having a control terminal and an output terminal with one of said external lines connected thereto, said each amplifier being configured to output one of the generated pixel drive voltages to the one external line via the output terminal and to operate with a transition speed based on a voltage supplied thereto via the control terminal;

a bias voltage supply line having its opposed ends that are respectively a first end and a second end; and a bias voltage generating part that generates a bias voltage and supplies said bias voltage across said opposed ends so that said first end has a voltage higher than a voltage than at said second end, wherein for each of said amplifiers, said bias voltage supply line is connected to the control terminal of said each amplifier so that the longer a length of the external line connected to the output terminal of said each amplifier is, the shorter a length of said bias voltage supply line between the control terminal of said each amplifier and said first end of the bias voltage supply line is, and wherein an external line at one side of the display is the shortest, and each of said external lines are longer in length as they approach the other side of the display.

2. The driving device for a display device according to claim 1, wherein an operating current of each of the plurality of the amplifiers varies in accordance with the voltage supplied to the control terminal of said each amplifier.

3. The driving device for a display device according to claim 1, wherein a bias voltage amplifier amplifying said bias voltage is provided between said first end and an output of said bias voltage generating part.

4. A driving device for a display device, comprising:

a source driver that applies pixel drive voltages respectively denoting luminance levels of pixels to a plurality of source lines of the display device via external lines respectively, wherein said source driver includes:

a first group of amplifiers provided corresponding to source lines in charge of the left region of a two-dimensional screen of said display device from among the plurality of source lines and that generate first pixel drive voltages for said left region of said pixel drive voltages to send onto first external lines for said left region of said external lines respectively;

a second group of amplifiers provided corresponding to source lines in charge of the right region of the two-dimensional screen of said display device from among the plurality of source lines and that generate second pixel drive voltages for said right region of said pixel drive voltages to send onto second external lines for said right region of said external lines respectively;

a bias voltage generating part that generates a bias voltage for controlling output delays of said first and second groups of amplifiers;

a first bias voltage supply line to supply therethrough said bias voltage to said first group of amplifiers; and a second bias voltage supply line to supply therethrough said bias voltage to said second group of amplifiers, wherein said bias voltage generating part has a first terminal connected to one end of said first bias voltage supply line, a second terminal connected to the other end thereof, a third terminal connected to one end of said second bias voltage supply line, and a fourth terminal connected to the other end thereof, wherein in a first mode, said bias voltage is applied to said first terminal and said third terminal, and simultaneously a voltage lower than said bias voltage is applied to said second terminal and said fourth terminal, and in a second mode, with said second terminal and said fourth terminal being short-circuited, said bias voltage is applied to said first terminal, and simultaneously a voltage lower than said bias voltage is applied to said third terminal, and in a third mode, with said second terminal and said fourth terminal being short-circuited, said bias voltage is applied to said third terminal, and simultaneously a voltage lower than said bias voltage is applied to said first terminal, and wherein the longer the length of said external line connected to any of said amplifiers is, the shorter the length of said first and second bias voltage supply lines connecting a terminal to which said bias voltage is applied from among said first and third terminals and an input terminal of said amplifier is, and wherein an external line at one side of the display is the shortest, and each of said external lines are longer in length as they approach the other side of the display.

5. The driving device for a display device according to claim 4, wherein the higher said bias voltage is, the smaller the output delays of said amplifiers are.

6. The driving device for a display device according to claim 4, wherein a bias voltage amplifier part to amplify said bias voltage is provided between each of said first and third terminals and said one end of said bias voltage supply line.

* * * * *